US008197919B2

(12) United States Patent
Overberg et al.

(10) Patent No.: US 8,197,919 B2
(45) Date of Patent: Jun. 12, 2012

(54) INKJET RECORDING MATERIAL WITH PERFORATED BACKSIDE RESIN LAYER

(75) Inventors: Andreas Overberg, Osnabrück (DE); Rainer Steinbeck, Osnabrück (DE)

(73) Assignee: Schoeller Technocell GmbH & Co. KG, Osnabruck (DE)

( * ) Notice: Subject to any disclaimer, the term of this patent is extended or adjusted under 35 U.S.C. 154(b) by 434 days.

(21) Appl. No.: 12/311,769

(22) PCT Filed: Oct. 9, 2007

(86) PCT No.: PCT/EP2007/060695

§ 371 (c)(1), (2), (4) Date: Jul. 10, 2009

(87) PCT Pub. No.: WO2008/043751

PCT Pub. Date: Apr. 17, 2008

(65) Prior Publication Data

US 2010/0003427 A1 Jan. 7, 2010

(30) Foreign Application Priority Data

Oct. 13, 2006 (EP) ..... 06122286

(51) Int. Cl.
*B41M 5/40* (2006.01)

(52) U.S. Cl. ..... 428/32.21; 428/32.22; 428/32.24; 428/32.25; 428/32.34

(58) Field of Classification Search ..... 428/32.21, 428/32.22, 32.24, 32.25, 32.34
See application file for complete search history.

(56) References Cited

U.S. PATENT DOCUMENTS

| | | | | |
|---|---|---|---|---|
| 5,472,757 | A * | 12/1995 | Ogawa et al. | 428/32.24 |
| 5,670,226 | A * | 9/1997 | Yoshizawa et al. | 428/40.1 |
| 2006/0073313 | A1 * | 4/2006 | Nasser | 428/195.1 |

FOREIGN PATENT DOCUMENTS

| | | |
|---|---|---|
| DE | 10020346 | 11/2000 |
| DE | 10318874 | 11/2003 |
| EP | 1270248 | 1/2003 |
| JP | 2000-301829 | 10/2000 |
| JP | 2002-225423 | 8/2002 |
| JP | 2004-034073 | 2/2004 |
| WO | WO 2008/043751 | 4/2008 |

OTHER PUBLICATIONS

International Search Report dated Jan. 8, 2008.

* cited by examiner

*Primary Examiner* — Betelhem Shewareged
(74) *Attorney, Agent, or Firm* — Honigman Miller Schwartz & Cohn LLP; Thomas A. Wootton; Jonathan P. O'Brien

(57) ABSTRACT

A recording material comprises a machine-finished paper which is coated with a synthetic resin on at least one side and at least one porous image recording layer, wherein the machine-finished paper is coated with a synthetic resin at least on the rear-side and this rear-side synthetic resin layer is perforated in such a way that the perforation holes reach as far as into the machine-finished paper, wherein the penetration depth is at most 1.5 to 4 times the synthetic resin layer thickness.

31 Claims, No Drawings

INKJET RECORDING MATERIAL WITH PERFORATED BACKSIDE RESIN LAYER

This application is the U.S. National phase of PCT Application No. PCT/EP2007/060695 filed Oct. 9, 2007, which claims the priority of EP Application No. 06 122 286.5 filed Oct. 13, 2006. Both of these documents are incorporated herein in their entirety.

The invention relates to a recording material for inkjet recording techniques with a resin-coated paper support and a method for its manufacture.

Recording materials for inkjet printing techniques, which comprise a resin-coated paper as the support material for recording layers, are abundantly described in prior art. The reason why these resin-coated papers are used can be traced back to the desire to achieve a quality comparable to a photograph. One important property of such paper supports is their smooth, high-gloss surface.

These resin-coated base papers usually consist of sized raw base paper preferably coated on both sides with polyolefin via (co)extrusion. The raw base paper is usually extrusion coated using thermoplastic polymers like low-density polyethylene LDPE, ethylene/a-olefin copolymer so-called linear low-density polyethylene (LLDPE)), high-density polyethylene (HDPE) and polypropylene.

Since the polyolefin layer acts as a barrier for the ink and the raw base paper cannot absorb the liquid ink when using such support materials, the recording layer(s) applied thereto must exhibit a high absorptive capacity, which can be achieved, for example, through the use of high-absorptive inorganic particles. Fine particles with a particle size of less than 1000 nm are used to retain the gloss required for photographic quality.

These so-called microporous recording materials, which consist of at least one ink-absorbing layer containing fine inorganic particles and a polyethylene-coated paper support, are described in numerous patent specifications, for example in DE 103 18 874 A1, DE 100 20 346 A1, JP 2002-225423 A, JP 2000-301 829 A or JP 2003-034073A. The latter patent specification describes a recording material that comprises a base paper coated on at least one side with a thermoplastic resin as the support, and an ink-absorbing layer, wherein the support is uniformly perforated starting from the front side to achieve good ink absorption. The disadvantage to this material is its poor surface and bad image quality after printing.

Another way to increase the absorption capacity of a recording layer is to use swellable polymers like gelatins or polyvinyl alcohol. The latter recording layers, which predominantly comprise the mentioned polymers, generally contain little, if any, pigments. The disadvantage to these recording materials is that the material only absorbs the liquid ink very slowly.

If the microporous recording layers printed on the front side are covered immediately after printing, undesired migration of printing ink colors takes place, a process known as "bleeding". In practice, the printed papers become covered when placing the fresh printout in film packaging, albums or when stacking several printouts in the printer.

To avoid or reduce the problem of bleeding, an attempt is made to physically or chemically fixate the ink dyes. Physical fixation requires that the layer surface exhibit a charge opposite that of the dye. Since the ink dyes are usually anionic, fixation takes place with the help of cationic compounds and/or cationically modified pigment particles.

EP 1 270 248 A1 attempts to resolve the bleeding problem by adding to the color-receiving layer a water-soluble compound, the primary framework of which must exhibit a specific ionization energy. These compounds include dialkyl thioether, trialkylamine, phenol and thiophene.

Therefore, the object of the invention is to provide a recording material that exhibits a good image quality, a high gloss as well as good bleeding behavior during storage. In addition, the aim is to preserve all other properties, such as water resistance or light stability.

Another object of the invention is to propose a method with which the recording material according to the invention can be manufactured.

This object is achieved by means of a recording material that comprises a raw base paper coated on at least one side with a synthetic resin and at least one image recording layer, wherein the raw base paper is coated with a synthetic resin at least on the back side, and this synthetic resin layer on the back side is perforated in such a way that the perforated holes extend into the raw base paper, and the impression depth amounts to at most $A+0.75\times B$, wherein A is the thickness of the synthetic resin layer, and B is the thickness of the raw base paper.

The area of the perforated holes preferably amounts to 0.005 to 1.0 $mm^2$, but in particular 0.1 to 0.6 $mm^2$.

In a preferred embodiment of the invention, the portion/share of perforated area in the overall area of the synthetic resin layer amounts to less than 10%, preferably less than 3%, but in particular 0.1 to 2%.

The number of perforated holes preferably amounts to less than 50/$cm^2$, in particular 2 to 20/$cm^2$. However, especially good results were achieved at a number ranging from 2 to 10/$cm^2$.

The method for manufacturing the recording material according to the invention can comprise the following steps:

- coating the back side of the raw base paper with a synthetic resin layer,
- perforating the synthetic resin layer on the back side, wherein the impression depth amounts to at most $A+0.75\times B$ (A=thickness of synthetic resin layer, B thickness of the raw base paper),
- coating the front side of the raw base paper with a synthetic resin layer,
- coating the synthetic resin layer on the front side with at least one image-recording layer.

The perforated holes can exhibit varying shapes. Slotted, elliptical or circular perforated holes are especially preferred. They can be arranged in a line or offset relative to each other. The perforated holes must exhibit a minimum impression depth corresponding to the thickness A of the synthetic resin layer. However, the impression depth must not exceed $A+0.75\times B$, in particular $A+0.5\times B$ (B thickness of raw base paper), since losses in strength and a deterioration in the material surface can otherwise be observed. Perforation can be performed with the help of a roll or several rolls, the surface(s) of which is/are provided with needles or knife-like elevations. However, a perforation can also be generated by subjecting the surface of the synthetic resin layer to laser and/or corona irradiation.

In another embodiment of the manufacturing method, another functional layer, such as an antistatic layer, anti-curl layer, or sheet-feed improving layer is applied to the perforated back of the synthetic resin layer before coating the front side of the raw base paper with a synthetic resin layer.

In another embodiment of the method, the additional function layer can be applied to the synthetic resin layer on the back side before it is perforated. Perforation then takes place in the next step, after which the front side of the raw base paper is coated with a synthetic resin layer, whereupon the synthetic resin layer on the front side is coated with at least one image recording layer.

Embodiments involving the following sequence of steps are also possible according to the invention:

After the synthetic layer on the back side has been perforated, the front side of the raw base paper is coated with a synthetic resin layer, after which the perforated synthetic resin layer on the back side is coated with another functional layer, whereupon the synthetic resin layer on the front side is coated with an image recording layer.

The back side of the raw base paper base is initially coated with a synthetic resin layer. The front side of the raw base paper is then coated with a synthetic resin. In the next step, the additional functional layer can be applied to the synthetic resin layer on the back side. The coated paper is subsequently perforated on the back side, and provided with an image recording layer on the front side.

The back side of the raw base paper is initially coated with a synthetic resin layer. The front side of the raw base paper is then coated with a synthetic resin. In the next step, the synthetic resin layer on the back side is coated with another functional layer. The image recording layer is subsequently applied to the synthetic resin layer on the front side. Finally, the recording material is perforated on the back side.

Another embodiment of the method according to the method provides for coating the front side of the raw base paper with a layer containing a hydrophilic binder and, if necessary, a pigment. The back side of the raw base paper is then coated with a synthetic resin layer, which is followed by perforation.

For purposes of the invention, the term raw base paper refers to an uncoated or surface sized paper. In addition to pulp fibers, raw base paper can contain sizing agents like alkyl kentene dimers, fatty acids and/or fatty acid salts, epoxydized fatty acid amides, alkenyl- or alkyl succinic acid anhydride, wet-strength agents like polyamine-polyamide-epichlorohydrin, dry-strength agents like anionic, cationic or amphoteric polyamides, optical brighteners, fillers, pigments, dyes, defoaming agents and other aids known in the paper industry. The raw base paper can be surface sized. Sizing agents suitable for this purpose include polyvinyl alcohol or oxidized starch. The raw base paper can be manufactured on a Fourdrinier or Yankee paper machine (cylinder paper machine). The basis weight of the raw base paper can measure 50 to 250 g/m$^2$, in particular 80 to 180 g/m$^2$. The raw base paper can be used in uncompressed or compressed (calendered) form. Raw base paper with a density of 0.8 to 1.2 g/cm$^3$, in particular 0.90 to 1.1 g/cm$^3$, are especially well suited.

The pulp fibers can be bleached hardwood kraft pulp (LBKP), bleached softwood kraft pulp (NBKP), bleached hard wood sulfite pulp (LBSP) or bleached softwood sulfite pulp (NBSP). These can also be mixed together. In particular, however, pulp fibers made of 100% leaf (hardwood) wood pulp are used. The average fiber length of the unrefined pulp preferably amounts to 0.6 to 0.85 mm (Kajaani measurement). In addition, the pulp has a lignin content of less than 0.05% w/w, in particular 0.01 to 0.03% w/w, relative to the mass of the pulp.

Possible fillers for use in the raw base paper include kaolin, calcium carbonate in its natural forms, such as limestone, marble or dolomite rocks, precipitated calcium carbonate, calcium sulfate, barium sulfate, titanium dioxide, talcum, silica, aluminum oxide and mixtures thereof. Especially suited is calcium carbonate with a particle size distribution in which at least 60% of the particles are smaller than 2 μm, and at most 40% are smaller than 1 μm. In a special embodiment of the invention, use is made of calcite with a particle size distribution in which about 25% of the particles exhibit a particle size of less than 1 μm, and about 85% of the particles exhibit a particle size of less than 2 μm.

The synthetic resin layer situated on at least one side of the raw base paper can preferably contain a thermoplastic polymer. Especially suited for this are polyolefins, for example, low-density polyethylene (LDPE), high-density polyethylene (HDPE), ethylene copolymers like ethylene/α-olefin copolymers (LLDPE) or ethylene/vinyl acetate copolymer, polypropylene and mixtures thereof, as well as polyester.

The synthetic resin layer can contain white pigments like titanium dioxide and other aids, such as optical brighteners, dyes and dispersing aids. The coating weight of the synthetic resin layer can amount to 5 to 50 g/m$^2$, in particular 10 to 45 g/m$^2$. The synthetic resin layer can be extruded in a single layer or co-extruded in multiple layers. Extrusion coating can take place at machine speeds of up to 600 m/min.

In another embodiment of the invention, the synthetic resin layer can be a polymer film or biaxially oriented polymer film. Especially well suited are polyethylene or polypropylene films with a porous core layer and at least one unpigmented or white pigmented, pore-free surface layer situated on at least one side of the core layer. The polymer film can be laminated onto the raw base paper in an extrusion process, wherein a primer agent, such as polyethylene, can be used simultaneously. The polymer film can be laminated onto the front and/or back side.

According to the invention, the synthetic resin layer is applied at least to the back side of the raw base paper.

In a preferred embodiment of the invention, the back side of the raw base paper is coated with a clear, i.e., pigment-free polyolefin, in particular polyethylene. A polyethylene mixture of LDPE and HDPE is especially preferred, wherein the quantity ratio LD/HD amounts to 9:1 to 1:9, in particular 3:7 to 7:3. The coating weight of the synthetic resin layer on the back side can amount to 5 to 50 g/m$^2$, in particular 10 to 45 g/m$^2$, or, in another preferred embodiment, 20 to 45 g/m$^2$. The thickness of the synthetic resin layer on the back side preferably ranges from 3 to 48 g/m$^2$, in particular from 9 to 38 μm.

In another preferred embodiment of the invention, the front side of the raw base paper is coated with a synthetic resin layer containing at least 50% w/w, in particular 80% w/w, of a low-density polyethylene with a density of 0.910 to 0.930 g/cm$^3$ and a melt flow index of 1 to 20 g/10 min relative to the synthetic resin layer. The synthetic resin layer on the front side can contain up to 20% w/w of a white pigment, in particular 2 to 10% w/w, relative to the mass of the layer.

The coating weight of the synthetic resin layer on the front side can amount to 10 to 50 g/m$^2$, in particular 10 to 30 g/m$^2$. The thickness of the synthetic resin layer on the front side can preferably amount to 5 to 47 μm, in particular 9 to 28 μm.

The back side of the support material can also exhibit other functional layers like an antistatic layer, an anti-curl layer, a layer that improves the printability of the back side of the recording material, or a layer that improves sheet feed in the printer. The functional layers can be applied to the back side before or after the synthetic resin layer on the back side has been perforated. They preferably incorporate latex-containing binders like styrene/butadiene, styrene/acrylate latex and additional components as required, e.g., matting agents, spacers, pigments, dyes, cross-linking agents and wetting agents. However, other binders can also be used, such as polyvinyl alcohols or cellulose derivatives. The coating weight of the functional layer preferably ranges from 0.05 to 3 g/m$^2$, in particular 0.1 to 2 g/m$^2$.

In another embodiment of the invention, another layer containing a hydrophilic binder can be situated between the raw base paper and the synthetic resin layer. Especially suited for this purpose are film forming starches like thermally modified starches, in particular cornstarches or hydroxypropylated starches. In a preferred form of the invention, low-viscous starch solutions are used, wherein the Brookfield viscosities range from 50 to 600 mPas (25% solution, 50° C./100 RPM), in particular 100 to 400 mPas, preferably 200 to 300 mPas. The Brookfield viscosity is measured according to ISO 2555. The binder preferably contains no synthetic latex. The lack of a synthetic binder enables the reuse of waste materials without any advance processing.

The layer containing a hydrophilic binder can preferably comprise other polymers, like polyamide copolymers and/or polyvinyl amine copolymers. The polymer can be used in a quantity of 0.4 to 5% w/w relative to the mass of the pigment. In a preferred embodiment, the quantity of this polymer amounts to 0.5 to 1.5% w/w.

The layer containing the hydrophilic binder can be arranged directly on the front side of the raw base paper or on the back side of the raw base paper. It can be applied to the raw base paper as a single layer or in multiple layers. The coating compound can be applied inline or offline with all application aggregates common in paper production, wherein the quantity is selected in such a way that the coating weight per layer amounts to at most 20 g/m$^2$ after drying, in particular 8 to 17 g/m$^2$, or, in an especially preferred embodiment, 2 to 6 g/m$^2$.

The layer arranged between the raw base paper and synthetic resin layer of the front side can preferably comprise a pigment. The pigment can be selected from the group of metal oxides, silicates, carbonates, sulfides and sulfates. Especially well suited are pigments like kaolins, talcum, calcium carbonate and/or barium sulfate.

Especially preferred is a pigment with a narrow particle size distribution, in which at least 70% of the pigment particles exhibit a size of less than 1 μm. In order to achieve the effect according to the invention, the percentage of pigment with the narrow particle size distribution relative to the entire pigment quantity should amount to at least 5% w/w, in particular 10 to 90% w/w. Especially good results can be achieved with a 30 to 80% w/w percentage of the total (?) pigment.

According to the invention, a pigment with a narrow particle size distribution is also regarded as a pigment with a particle size distribution in which at least about 70% w/w of the pigment particles exhibit a size of less than about 1 μm, and the difference between the pigment with the largest particle size (diameter) and pigment with the smallest particle size is less than about 0.4 μm in 40 to 80% w/w of these pigment particles. A calcium carbonate with a d50% value of about 0.7 μm proved to be especially advantageous.

In a special embodiment of the invention, use can be made of a pigment mixture consisting of the aforementioned calcium carbonate and kaolin. The quantity ratio between calcium carbonate and kaolin preferably amounts to 30:70 to 70:30.

The quantity ratio between the binder and pigment in the layer can amount to 0.1 to 2.5, preferably 0.2 to 1.5, but in particular about 0.9 to 1.3.

In a preferred embodiment of the invention, the raw base paper or the raw base paper coated with the layer containing a hydrophilic binder and a pigment can be coated on the back side with a synthetic resin layer and perforated, before it is provided on the front side with a synthetic resin layer in the next step, followed by at least one image recording layer. The perforation process can be executed with the help of a roll, the surface of which is provided with needles or knife-like elevations. The advantage to this sequence of the procedure is that the edges of the perforated holes are not copied to the synthetic resin layer on the front side, so that they cannot negatively affect the surface quality.

The resin-coated paper support material according to the invention is basically suitable for all image recording layers. However, the resin coated paper support material is used in particular for porous image recording layers, which contain fine inorganic and/or organic pigment particles and a hydrophilic binder. Suitable pigments of the image recording layer according to the invention include for example aluminum oxide, aluminum hydroxide, aluminum oxide hydroxide, aluminum oxide hydrate, silicon dioxide, magnesium hydroxide, kaolin, titanium dioxide, zinc oxide, zinc hydroxide, calcium silicate, magnesium silicate, calcium carbonate, magnesium carbonate and barium sulfate. The quantity of pigment in the ink receiving layer can amount to 40 to 95% w/w, preferably 60 to 90% w/w, relative to the weight of the dried layer.

The particle size distribution of the pigment of the ink receiving layer preferably amounts to less than 1000 nm, but in particular 50 to 500 nm. The average particle size of the primary particles preferably amounts to less than 100 nm, in particular less than 50 nm.

The ink receiving layer comprises a water soluble and/or water dispersible binder. Suitable binders include for example polyvinyl alcohol, completely or partially saponified, cationically modified polyvinyl alcohol, silyl-group exhibiting polyvinyl alcohol, acetal group-exhibiting polyvinyl alcohol, gelatins, polyvinyl pyrrolidone, starch, carboxymethyl cellulose, polyethylene glycol, styrene/butadiene latex and styrene/acrylate latex. Completely or partially saponified polyvinyl alcohols are especially preferred. The quantity of binder can amounts to 60 to 5% w/w, preferably 50 to 10% w/w, but in particular 35 to 8% w/w, relative to the weight of the dried layer.

The ink receiving layer can comprise conventional additives and aids like cross-linking agents, ionic and/or nonionic surfactants, dye-fixating agents like polyammonium compounds, UV absorbers, antioxidants and other agents that improve light stability and gas resistance, as well as other aids.

The coating weight of the ink receiving layer can amounts to 5 to 60 g/m$^2$, preferably 10 to 50 g/m$^2$, especially preferably 20 to 40 g/m$^2$.

The image recording layer can consist of a single layer or multiple layers. In a special embodiment of the invention, the image recording layer can be comprised of an ink-absorbing lower layer and a dye-fixating upper layer.

Suitable pigments of the ink-absorbing lower layer according to the invention include for example aluminum oxide, aluminum hydroxide, aluminum oxide hydroxide, aluminum oxide hydrate, silica, barium sulfate and titanium dioxide. A pigment based on aluminum oxide and/or aluminum oxide hydroxide is especially preferred in the lower layer. Such a pigment can be cationically modified. The concentration of pigment in the ink-absorbing layer amounts to 65 to 95% w/w, preferably about 70 to 90% w/w, relative to the weight of the dried layer.

The particle size distribution of the pigment in the ink-absorbing layer can preferably range from 70 to 1000 nm, preferably 130 to 400 nm, especially preferably 150 to 350 nm. The average particle size of the pigment in the ink-absorbing layer can amount to 240 to 350 nm, preferably 270 to 330 nm.

Suitable pigments in the dye-fixating layer according to the invention include for example aluminum oxide, aluminum hydroxide, aluminum oxide hydrate, silica, barium sulfate and titanium dioxide. The concentration of the pigment in the dye-fixating layer can amount to 70 to 95% w/w, preferably 80 to 90% w/w.

The particle size distribution of the pigment in the dye-fixating layer can preferably range from 50 to 200 nm, preferably 70 to 120 nm. The average particle size of the pigment in the dye-fixating layer can preferably amount to 70 to 120 nm, particularly at 100 nm.

The ink-absorbing and dye-fixating layer comprise a water soluble and/or water dispersible polymer binder. Suitable binders include for example polyvinyl alcohol, completely or partially saponified, cationically modified polyvinyl alcohol, silyl group-exhibiting polyvinyl alcohol, acetal group-exhibiting polyvinyl alcohol, acetate group-exhibiting polyvinyl alcohol, gelatins, polyvinyl pyrrolidone, starch, carboxymethyl cellulose, polyethylene glycol, styrene/butadiene latex and styrene/acrylate latex. The quantity of binder in the dye-fixating and ink-absorbing layer amounts to 5 to 35% w/w respectively, preferably 10 to 30% w/w, relative to the weight of the dried layer.

Both layers can comprise conventional additives and aids, like surfactants, cross-linking agents and dye-fixating agents.

The coating weights of the ink-absorbing and dye-fixating layer can amount to 10 to 60 g/m$^2$, preferably 20 to 50 g/m$^2$.

In another embodiment of the invention, additional layers like protective layers or gloss-improving layers can be applied to the image recording layer. The coating weight is preferably less than 1 g/m$^2$.

The following examples are intended to explain the invention in greater detail:

EXAMPLES

Raw Base Paper Manufacture

A eucalyptus pulp was used to manufacture the raw base paper. The pulp was refined as a roughly 5% aqueous suspension (high-density pulp) using a refiner to a freeness degree of 36° SR. The average fiber length amounted to 0.64 mm. The concentration of pulp fibers in the low-consistency pulp amounts to 1% w/w relative to the mass of the pulp suspension. Additives were added into the low-consistency pulp, such as a neutral sizing agent alkylkentene dimmer (AKD) in a quantity of 0.48% w/w, wet-strength agent polyamine-polyamide-epichlorohydrin resin (Kymene®) in a quantity of 0.36% w/w and a natural $CaCO_3$ in a quantity of 10% w/w.

The quantities indicated relate to the pulp mass. The low-consistency pulp with a pH-value set to about 7.5 was brought from the head box onto the screen of the paper machine, whereupon sheet formation took place while dewatering the web in the wire section of the paper machine. The paper web was further dewatered in the press section to a water content of 60% w/w relative to the web weight. Additional drying took place in the dryer section of the paper machine with heated dryer cylinders. This yielded a raw base paper with a basis weight of 160 g/m$^2$, and a moisture of roughly 7%.

Example 1

The back side of the raw base paper was coated in a laminator with a pigment-free synthetic resin mixture comprised of 40% w/w of a low-density polyethylene (LDPE, d=0.923 g/cm') and 60% of a high-density polyethylene (HDPE, d=0.964 g/cm'). Coating took place in a laminator at an extrusion rate of 250 m/min. The layer thickness amounted to 17 μm. After the extrusion process, the synthetic resin layer on the back side was perforated with a roll whose surface was fitted with small, needle-like elevations. The impression depth of perforation was 47 μm.

The front side of the paper support material fabricated in this way was coated with an aqueous coating compound containing 90% w/w aluminum oxide with a specific surface of 130 m$^2$/g, 9.9% w/w of a polyvinyl alcohol with a saponification degree of 88 mol. % and 0.1% w/w boric acid. The coating compound was applied with the help of a slot die coater. The coating weight of the obtained ink-receiving layer amounted to 30 g/m$^2$.

Example 2

The back side of the raw base paper was coated with a synthetic resin layer and perforated as in example 1. After the perforation process, the front side of the raw base paper was coated with a synthetic resin mixture comprised of 71% w/w of low-density polyethylene (LDPE, 0.923 g/cm$^3$), 16% w/w of a $TiO_2$ master batch (50% w/w LDPE and 50% w/w $TiO_2$) and 13% w/w other additives, such as optical brighteners, Ca stearate and blue pigment, with a coating weight of about 17 g/m$^2$ in a laminator at a rate of about 250 m/min. The thickness of the synthetic layer on the front side amounted to 17 μm. An ink-receiving layer was then applied to the synthetic resin layer on the front side as in example 1.

Example 3

The front side of the raw base paper was coated with the coating compound specified in greater detail below. The coating compound (solid matter content: 21% w/w, pH value=8.0, viscosity: 50 mPas) was plied with the help of a size press. The coating weight after drying amounted to 6.5 g/m$^2$.

The coating compound was comprised of the following components:

| | |
|---|---|
| Thermally modified starch*) | 47.0% w/w |
| $CaCO_3$**) | 26.4% w/w |
| Kaolin***) | 26.4% w/w |
| Acroflex ® (r) VX 610 | 0.2% w/w |

*)C-film 07302 (Cargill)/viscosity 234 mPas, measured at 50° C./100 RPM/spindle 2 for a solution with a solid matter content of 25% w/w.
**)$CaCO_3$ with 85% pigment particles <1 μm, (Covercarb ® (r) 85-ME, OMYA)
***)Kaolin with 65% pigment <1 μm, (Lithoprint ® (r) EM, OMYA)

A synthetic resin layer according to example 1 was applied to the back side of the above pigment-coated raw base paper and perforated. The thickness of the resin layer was 34 μm. The perforated holes exhibit an impression depth of 64 μm. The perforation process was followed by coating the front side of the pigment-coated raw base paper with a synthetic resin layer in a laminator as in example 2. The front side was subsequently coated with an ink-receiving layer as in example 1.

Example 4

Manufacture took place as in example 2, with the difference that the synthetic resin layer on the back side was coated with an aqueous coating compound containing 70% w/w polyvinyl alcohol with a saponification degree of 98 mol. % and 29.9% w/w colloidal silica as well as 0.1% w/w boric acid. The coating weight of the obtained coating amounted to 1 g/m$^2$. Subsequently, the back side was perforated, the front side was coated with the synthetic resin layer and the ink-receiving layer according to example 2.

COMPARISON EXAMPLES

Comparison Example 1

The recording material was manufactured as in example 2, but without perforating the synthetic resin layer on the back side.

Comparison Example 2

The recording material was manufactured as in example 4, but without perforating the synthetic resin layer on the back side.

Comparison Example 3

The recording material was manufactured as in example 2, the difference being that the front side was perforated, not the back side.

Comparison Example 4

Manufacturing took place as in example 2, the difference being that a pigment-free, polyvinyl alcohol-containing ink-receiving layer was applied.

Examination of the recording materials manufactured according to the examples and comparison examples.

Measurement of Migration Behavior (Bleed)

The recording papers according to the invention were printed in the HP 8250 inkjet printer and examined with regard to color location shift.

Migration can be assessed either a) visually or b) in color measurements, wherein the figures listed on the table relate to color measurement data:

a) In the fringe area between white, unprinted areas and areas heavily colored via inkjet printers, in case of stack printing when the front side of the printed paper is covered, the migration of dyes can be visually detected based on undesirable staining of unprinted areas, and evaluated based on limiting proof-samples.

b) More reliable evaluations are achieved by superimposing inkjet test prints on the microporous inkjet recording paper. After covering the printed recording paper to be inspected with the back side of other test recording paper (here: the recording paper according to the invention to be tested) and storing the "stack" (for 24 hours), the color values of defined measuring fields are measured on the printed paper. In addition, the color values of analogous printed measuring fields of uncovered papers are measured. The resulting color differences, indicated as ΔE values between the covered and uncovered samples, are a measure for migration. Small ΔE values denote a low migration tendency of the colors in the stack. The ΔE values are averaged values for the 4 base colors cyan, magenta, yellow and black. They can be calculated with the following formula:

$$\Delta E = v(L1-L2)2+(a1-a2)2+(b1-b2)2$$

The measurements took place using the Gretag MacBeth Spectrolino color measuring device.

The procedure according to the invention and the test described here can only be used for microporous inkjet papers. If a color-receiving layer rich in binder is applied to the paper support material according to the invention and then covered and stored after printing, the printed side of the paper sticks to the back side of the overlying paper; migration can then no longer be assessed.

Test Results

| Examples | ΔE |
|---|---|
| Example 1 | 4.54 |
| Example 2 | 4.86 |
| Example 3 | 4.68 |
| Example 4 | 5.03 |
| Comparative example 1 | 20.86 |
| Comparative example 2 | 14.01 |
| Comparative example 3 | 19.95 |

We claim:

1. A recording material comprising a raw base paper coated at least on the back side with a synthetic resin and at least one porous image-recording layer on the front side of said raw base paper, wherein only the synthetic resin layer on the back side has perforated holes and the perforated holes extend into the raw base paper, wherein the impression depth of the perforated holes is at least 1.5 to 4 times the synthetic resin layer thickness, the percentage of the perforated area making up the overall area of the synthetic resin layer amounts to 0.1 to 2% and the area of the perforated holes amounts to 0.005 to 1.0 $mm^2$.

2. The recording material according to claim 1, wherein the number of perforated holes amounts to 2 to 20/$cm^2$.

3. The recording material according to claim 1, wherein the perforated holes are slotted, elliptical or circular.

4. The recording material according to claim 1, wherein the synthetic resin layer on the back side comprises at least 30% w/w HDPE with a density exceeding 0.935 g/$cm^3$.

5. The recording material according to claim 1, wherein the coating weight of the synthetic resin layer on the back side amounts 10 to 50 g/$m^2$.

6. The recording material according to claim 1, wherein the front side of the raw base paper is coated with a synthetic resin layer that comprises at least one LDPE with a density of 0.935 g/$cm^3$ or less.

7. The recording material according to claim 6, wherein the coating weight of the synthetic resin layer on the front side amounts to 10 to 30 g/$m^2$.

8. The recording material according to claim 1, wherein the raw base paper comprises 5 to 20% w/w filler based on the pulp mass.

9. The recording material according to claim 1, further comprising another layer comprising a hydrophilic binder located between the raw base paper and synthetic resin layer.

10. The recording material according to claim 9, wherein said another layer further comprises a pigment selected from the group of metal oxides, silicates, carbonates, sulfites and sulfates.

11. The recording material according to claim 1, wherein the image-recording layer comprises fine inorganic particles and a hydrophilic binder.

12. The recording material according to claim 11, wherein the inorganic particles exhibit an average particle size of the primary particles of less than 50 nm.

13. The recording material according to claim 11, wherein the image-recording layer comprises aluminum oxide, aluminum hydroxide, aluminum oxide hydrate, silicon dioxide, titanium dioxide, barium sulfate, calcium carbonate or mixtures thereof.

14. The recording material according to claim 1, wherein the image-recording layer is single-ply.

15. The recording material according to claim 1, wherein the image-recording layer comprises at least one lower ink-absorbing layer and at least one upper dye-fixing layer.

16. A method for manufacturing a recording material having a raw base paper coated at least on the back side with a synthetic resin and at least one porous image-recording layer on the front side of said raw base paper, comprising the following steps:

coating the back side of the raw base paper with a synthetic resin layer;

perforating the synthetic resin layer on the back side, wherein the impression depth of the perforated holes amounts to at most A+0.75×B, wherein A=thickness of the synthetic resin layer and B=thickness of the raw base paper;

coating the front side of the raw base paper with at least one porous image-recording layer.

17. The method of claim 16 further comprising coating the front side of the raw base paper with a synthetic resin layer, and then coating the synthetic resin layer on the front side with the at least one porous image-recording layer.

18. The method according to claim 16, wherein at least one side of the raw base paper is provided with a layer comprising a hydrophilic binder and a pigment.

19. The method according to claim 16, wherein another functional layer is applied to the perforated layer on the back side.

20. The method according to claim 16, wherein the synthetic resin layer on the back side comprises at least 30% w/w HDPE with a density of at least 0.935 g/cm$^3$.

21. The method according to claim 16, wherein the coating weight of the synthetic resin layer on the back side amounts to 10 to 45 g/m$^2$.

22. The method according to claim 16, wherein the synthetic resin layer on the front side comprises at least one LDPE with a density of 0.935 g/cm$^3$ or less.

23. The method according to claim 16, wherein the coating weight of the synthetic resin layer on the front side amounts to 10 to 30 g/m$^2$.

24. The method according to claim 19, wherein the functional layer contains a water-soluble and/or water-dispersible binder and a pigment.

25. The method according to claim 24, wherein the binder is a styrene/butadiene latex, a styrene/acrylate latex, a polyvinyl alcohol and/or a cellulose derivative.

26. The method according to claim 19, wherein the coating weight of the functional layer amounts to 0.1 to 2.0 g/m$^2$.

27. The method according to claim 16, wherein the image-recording layer comprises fine inorganic particles and a hydrophilic binder.

28. The method according to claim 27, wherein the inorganic particles exhibit an average particle size of the primary particles of less than 50 nm.

29. The method according to claim 16, wherein the image-recording layer comprises at least one lower ink-absorbing layer and at least one upper dye-fixing layer.

30. The method according to claim 16, wherein the image-recording layer comprises aluminum oxide, aluminum hydroxide, aluminum oxide-hydrate, silicon dioxide, titanium dioxide, barium sulfate, calcium carbonate or mixtures thereof.

31. The method according to claim 16, wherein the coating weight of the image-receiving layer amounts to 10 to 50 g/m$^2$.

* * * * *